US010397689B2

(12) United States Patent
Tang

(10) Patent No.: US 10,397,689 B2
(45) Date of Patent: Aug. 27, 2019

(54) DUAL WIRELESS EARPHONES

(71) Applicant: Qingdao GoerTek Technology Co., Ltd., Qingdao, ShanDong Province (CN)

(72) Inventor: Mingjun Tang, Qingdao (CN)

(73) Assignee: QINGDAO GOERTEK TECHNOLOGY CO., LTD., Qingdao, Shandong Province (CN)

( * ) Notice: Subject to any disclaimer, the term of this patent is extended or adjusted under 35 U.S.C. 154(b) by 0 days.

(21) Appl. No.: 16/067,787

(22) PCT Filed: Dec. 31, 2016

(86) PCT No.: PCT/CN2016/114034

§ 371 (c)(1),
(2) Date: Jul. 2, 2018

(87) PCT Pub. No.: WO2017/152705

PCT Pub. Date: Sep. 14, 2017

(65) Prior Publication Data

US 2019/0020942 A1 Jan. 17, 2019

(30) Foreign Application Priority Data

Mar. 7, 2016 (CN) ..... 2016 1 0126541

(51) Int. Cl.
*H04R 1/10* (2006.01)
*H04R 5/033* (2006.01)

(52) U.S. Cl.
CPC ..... *H04R 1/1066* (2013.01); *H04R 1/1016* (2013.01); *H04R 1/1033* (2013.01);
(Continued)

(58) Field of Classification Search
CPC combination set(s) only.
See application file for complete search history.

(56) References Cited

U.S. PATENT DOCUMENTS

2005/0207606 A1* 9/2005 Yang ..... H04R 1/1075 381/370
2007/0141915 A1* 6/2007 Kim ..... H01R 13/6608 439/640

(Continued)

FOREIGN PATENT DOCUMENTS

CN 101325817 A 12/2008
CN 102647649 A 8/2012

(Continued)

OTHER PUBLICATIONS

Translation of Yang (CN103297892), Jun. 27, 2013, "Multi-functional portable headset".*

(Continued)

*Primary Examiner* — Regina N Holder
(74) *Attorney, Agent, or Firm* — Arent Fox, LLP

(57) ABSTRACT

A dual wireless earphones comprise two earphone bodies and a connecting cable assembly. The connecting cable assembly comprises a cable tube and two connectors fixedly connected to both ends of the cable tube respectively, one of the connectors is detachably connected to one of the earphone bodies, and the other connector is detachably connected to the other earphone body. In the dual wireless earphones according to the present disclosure, two earphone bodies are detachably connected by a connecting cable assembly, and when the dual wireless earphones are used, the two earphone bodies can be connected by the connecting cable assembly, thereby effectively avoiding the earphone bodies being dropped and lost when they are worn. Moreover, the user can choose whether to connect the two earphone bodies according to his preferences and usage scenarios, so the use of the dual wireless earphones is greatly facilitated.

10 Claims, 2 Drawing Sheets

(52) U.S. Cl.
CPC ..... *H04R 1/1041* (2013.01); *H04R 5/0335* (2013.01); *H04R 2201/105* (2013.01); *H04R 2420/07* (2013.01)

(56) References Cited

U.S. PATENT DOCUMENTS

| | | | | |
|---|---|---|---|---|
| 2009/0175473 | A1* | 7/2009 | Wong | H04R 1/1075 381/309 |
| 2016/0323664 | A1* | 11/2016 | Kirsch | H04R 1/1041 |

FOREIGN PATENT DOCUMENTS

| | | | |
|---|---|---|---|
| CN | 103297892 | A | 9/2013 |
| CN | 104581479 | A | 4/2015 |
| CN | 204272348 | U | 4/2015 |
| CN | 204316699 | U | 5/2015 |
| CN | 104683905 | A | 6/2015 |
| CN | 204518028 | U | 7/2015 |
| CN | 204948299 | U | 1/2016 |
| CN | 105578335 | A | 5/2016 |
| CN | 205408114 | U | 7/2016 |
| KR | 101365926 | B1 | 2/2014 |
| WO | 2016023132 | A1 | 2/2016 |

OTHER PUBLICATIONS

Chinese Office Action issued in Chinese Application No. 201610126541.8 dated Mar. 12, 2018.
International Search Report issued in International Patent Application No. PCT/CN2016/114034 dated Mar. 1, 2017.
Type of Search issued in Chinese Application No. 201610126541.8.
European Search Report corresponding to European Application No. 16893347, dated Dec. 11, 2018.

* cited by examiner

DUAL WIRELESS EARPHONES

CROSS-REFERENCE TO RELATED APPLICATION

This application is a U.S. National Stage entry under 35 U.S.C. § 371 based on International Application No. PCT/CN2016/114034, filed on Dec. 31, 2016, which was published under PCT Article 21(2) and which claims priority to Chinese Patent Application No. 201610126541.8, filed on Mar. 7, 2016. The disclosure of the priority applications are hereby incorporated herein in their entirety by reference.

TECHNICAL FIELD

The present disclosure relates to dual wireless earphones.

BACKGROUND

Dual wireless earphones usually comprise two earphone bodies to achieve a dual channel or stereo effect. In the prior art, the two earphone bodies are separately arranged in structure, and there is not a connecting structure between them. When they are worn, it is inevitable that the earphone bodies will be dropped and lost due to loose wearing.

Therefore, there needs to be a new design of dual wireless earphones in which two earphone bodies are connected by a connecting cable and the possibility of the earphone bodies being dropped and lost can be reduced. In addition, other objects, desirable features and characteristics will become apparent from the subsequent summary and detailed description, and the appended claims, taken in conjunction with the accompanying drawings and this background.

SUMMARY

The present disclosure provides dual wireless earphones which can effectively reduce the possibility of the earphone bodies being dropped and lost.

To achieve the above object, the following technical solution is adopted in the present disclosure:

Dual wireless earphones comprising two earphone bodies, wherein the dual wireless earphones further comprise a connecting cable assembly, the connecting cable assembly comprises a cable tube and two connectors fixedly connected to both ends of the cable tube respectively, one of the connectors is detachably connected to one of the earphone bodies, and the other connector is detachably connected to the other earphone body.

The technical solution of the present disclosure may further include the following additional features:

Deformable support rods are provided and fixed inside the cable tube and at both ends of the cable tube.

The connector comprises a connector body and a detachable connecting structure disposed on the connector body; the connector is fixedly connected to the end of the cable tube by fixedly connecting the connector body with the cable tube; a detachable connecting structure corresponding to the detachable connecting structure of the connector is provided on the earphone body; and a detachable connecting between the earphone body and the connector is achieved by engagement of the two detachable connecting structures.

The detachable connecting structures are a magnetic attraction structure or a clamping structure.

A data transmission line is provided in the cable tube, an elastic probe is provided in the connector body, a copper post is disposed in the earphone body corresponding to the elastic probe, an outer end of the data transmission line is in contact with the elastic probe, and the elastic probe is in contact with the copper post, so that the two earphone bodies are connected by the copper post, the elastic probe and the data transmission line to balance the electric quantities of the two earphone bodies.

Opposite side walls of the earphone body are both provided with the detachable connecting structure.

Opposite side walls of the earphone body are both provided with the detachable connecting structure and the copper post.

Unlike the prior art, in the dual wireless earphones according to the present disclosure, two earphone bodies are detachably connected by a connecting cable assembly, and when the dual wireless earphones are used, the two earphone bodies can be connected by the connecting cable assembly, thereby effectively avoiding the earphone bodies being dropped and lost when they are worn. Moreover, the user can choose whether to connect the two earphone bodies according to his preferences and usage scenarios, so the use of the dual wireless earphones is greatly facilitated.

BRIEF DESCRIPTION OF DRAWINGS

The present disclosure, will hereinafter be described in conjunction with the following drawing figures, wherein like numerals denote like elements, and.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

The technical solutions of the present disclosure will be further described in detail below with reference to the accompanying drawings and specific embodiments.

Figure 1:
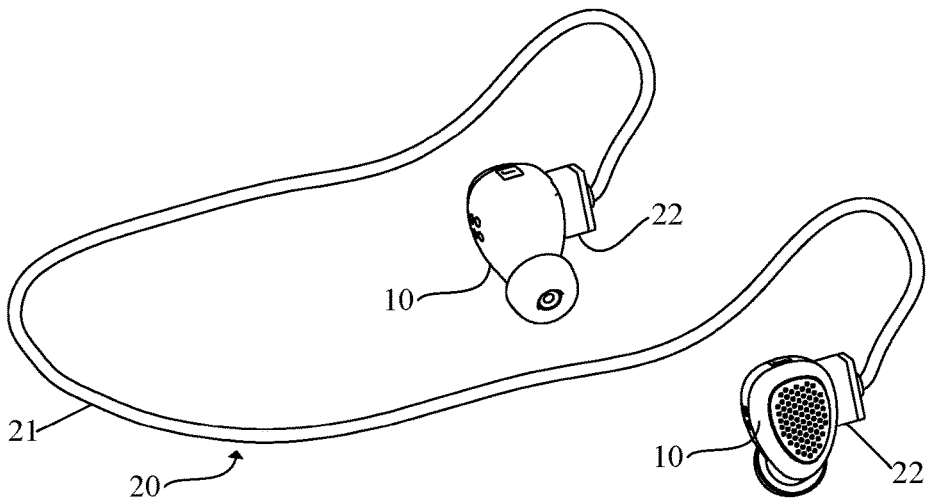
FIG. 1 is a schematic diagram of dual wireless earphones according to the present disclosure in which two earphone bodies are connected by a connecting cable assembly.

Dual wireless earphones comprising two earphone bodies 10 further comprise a connecting cable assembly 20. The connecting cable assembly comprises a cable tube 21 and two connectors 22. The two connectors 22 are fixedly connected to two ends of the cable tube 21 respectively. One of the connectors 22 is detachably connected to one of the earphone bodies 10, and the other connector 22 is detachably connected to the other earphone body 10. When the two earphone bodies 10 are connected by the connecting cable assembly 20, the structure of the dual wireless earphones is as shown in FIG. 1. When the connecting cable assembly 20 and the two earphone bodies 10 are detached, the structure of the dual wireless earphones is as shown in FIG. 2.

In the present embodiment, besides the two earphone bodies, the dual wireless earphones further comprise a connecting cable assembly. When the dual wireless earphones are used, the user can choose whether to use the connecting cable assembly to connect the two earphone bodies according to his preferences, usage habits or usage scenarios, thereby improving the humanized design and the ease of use of the dual wireless earphones. When the connecting cable assembly is used to connect the two earphone bodies, the possibility of the earphone bodies being dropped and lost due to loose wearing can be effectively reduced or even avoided.

Figure 3:
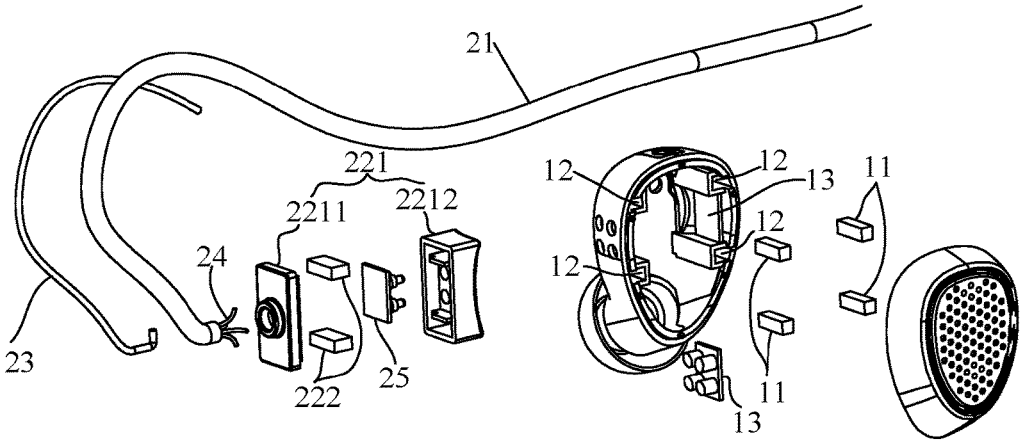
FIG. 3 is an exploded structural view of one end of the connecting cable assembly and an earphone body at this end of dual wireless earphones according to the present disclosure.

In order to properly position the connecting cable assembly 20 when the earphones are worn, deformable support rods 23 are provided and fixed inside the cable tube 21 and at both ends of the cable tube 21, as shown in FIG. 3. The deformable support rods 23 may be made of copper wires or other deformable materials. If the deformable support rods 23 are embedded at both ends of the cable tube 21 close to the earphone bodies 10, 20, the deformable support rods 23 will be located at the user's ear, and the deformable support rods 23 can be further hung on the user's ear, so that the dual wireless earphones becomes ear-hook type earphones, and the normal movement of the user will not be affected by the shaking of the connecting cable assembly 20. Moreover, since the deformable support rods 23 can be deformed, their shape can be adjusted according to the shape of the ear contour of the user to make the wearing more comfortable, fixed and stable.

Figure 2:
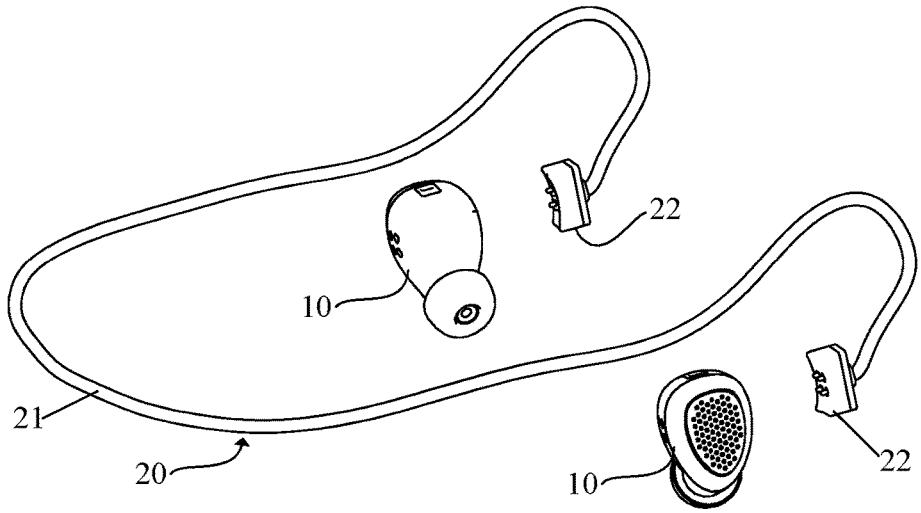
FIG. 2 is a schematic structural diagram of dual wireless earphones according to the present disclosure in which two earphone bodies and the connecting cable assembly are detached.

As shown in FIG. 1 to FIG. 3, the specific structure of the connector 22 comprises a connector body 221 and a detachable connecting structure 222 disposed on the connector body 221. The connector 22 is fixedly connected to the end of the cable tube 21 by fixedly connecting the connector body 221 with the cable tube 21. A detachable connecting structure 11 corresponding to the detachable connecting structure 222 of the connector 22 is provided on the earphone body 10. The detachable connecting between the earphone body 10 and the connector 22 is achieved by the engagement of two detachable connecting structures.

Figure 4:
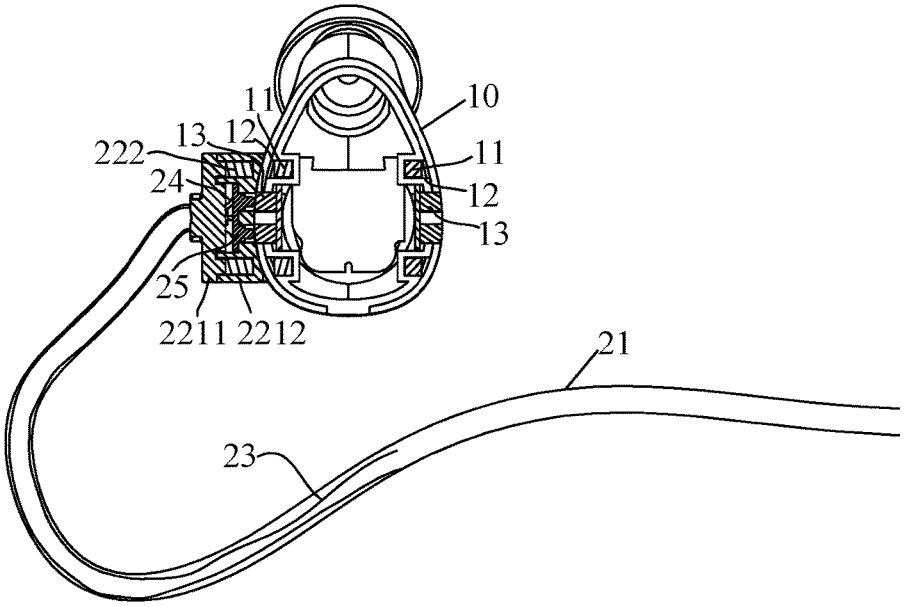
FIG. 4 is a cross section view of one end of the connecting cable assembly and an earphone body at this end of dual wireless earphones according to the present disclosure.

Specifically, as shown in FIG. 3 and FIG. 4, in the present embodiment, the detachable connecting structure 222 on the connector body 221 is a magnet, the detachable connecting structure 11 on the earphone body 10 is a magnet or a ferromagnetic material, and the connection between the connector 22 and the earphone body 10 is achieved by a magnetic attraction structure. Of course, the detachable connecting structures may also be a clamping structure. For example, a buckle is provided on the connector 22, a clamping groove or a clamping hole is provided on the earphone body 10 correspondingly, and the fixed connection between the connector 22 and the earphone body 10 is achieved by clamping.

In order to enable the earphone bodies 10 to be used freely regardless of left and right and improve the ease of use, in the present embodiment, opposite side walls of the earphone body 10 are both provided with the detachable connecting structure 11, and the detachable connecting structures 11 on both sides are arranged symmetrically, as shown in FIG. 3 and FIG. 4.

Further, in the present embodiment, the connector body 221 and the earphone body 10 are detachably connected by magnetic attraction. Specifically, the connector body 221 comprises an upper cover 2211 and a lower cover 2212 which form a box by aligning and gluing. The detachable connecting structure 222 is a magnet, and is fixed in a box body surrounded by the upper cover 2211 and the lower cover 2212. The end of the cable tube 21 is embedded in the connector body 221, and the end of the deformable support rods 23 inside thereof is inserted into the connector body 221 and then bent and hooked on the connector body 221 to achieve the fixed connection between the cable tube 21 and the connector body 221. A clamping groove 12 for positioning a magnet (or ferromagnetic material) is provided on the inner wall of the earphone body 10. The detachable connecting structure 11 on the earphone body 10 is clamped in the clamping groove 12. The detachable connecting structure 11 and the detachable connecting structure 222 on the connector body 221 face each other to ensure magnetic attraction. When the connecting cable assembly 20 and the earphone body 10 need to be separated, they can be separated by hand.

In dual wireless earphones, usually one of the two earphone bodies 10 is a master earphone and the other is a slave earphone. Since the master earphone consumes much more power than the slave earphone does, the electric quantities in the two earphone bodies are unbalanced, which affects the use. In order to solve this problem and balance the electric quantities of the master earphone and the slave earphone, in the present embodiment, a data transmission line 24 is provided in the cable tube 21 of the connecting cable assembly 20, an elastic probe 25 is provided in the connector body 221, and a copper post 13 is disposed in the earphone body 10 corresponding to the elastic probe 25. The outer end of the data transmission line 24 is in contact with the elastic probe 25, and the elastic probe 25 is in contact with the copper post 13, so that the two earphone bodies 10 are connected by the copper post 13, the elastic probe 25 and the data transmission line 24 to balance the electric quantities of the two earphone bodies 10, as shown in FIG. 3 and FIG. 4.

Similarly, in order to enable the earphone bodies 10 to be used freely regardless of left and right and improve the ease of use, in the present embodiment, opposite side walls of the earphone body 10 are both provided with the detachable connecting structure 11 and the copper post 13, and the detachable connecting structures 11 and the copper post 13 on both sides are arranged symmetrically, as shown in FIG. 3 and FIG. 4.

The above embodiments are only used to illustrate, rather than limit, the technical solutions of the present disclosure. Although the present disclosure has been described in detail with reference to the foregoing embodiments, a person skilled in the art can still modify the technical solutions of the above embodiments, or replace equivalently some of the technical features. Those modifications or replacements do not make the nature of the corresponding technical solutions depart from the spirit and scope of the technical solutions that the claims seek to protect.

What is claimed is:

1. Dual wireless earphones comprising two earphone bodies, wherein the dual wireless earphones further comprise a connecting cable assembly, the connecting cable assembly comprises a cable tube and two connectors fixedly connected to both ends of the cable tube respectively, one of the connectors is detachably connected to one of the earphone bodies, and the other connector is detachably connected to the other earphone body;

the connector comprises a connector body and a detachable connecting structure disposed on the connector body;

the connector is fixedly connected to the end of the cable tube by fixedly connecting the connector body with the cable tube; and a data transmission line is provided in the cable tube, an elastic probe is provided in the connector body, a copper post is disposed in the earphone body corresponding to the elastic probe, an outer end of the data transmission line is in contact with the elastic probe, and the elastic probe is in contact with the copper post.

2. The dual wireless earphones according to claim 1, wherein deformable support rods are provided and fixed inside the cable tube and at both ends of the cable tube.

3. The dual wireless earphones according to claim 2, wherein a detachable connecting structure corresponding to the detachable connecting structure of the connector is provided on the earphone body; and a detachable connecting between the earphone body and the connector is achieved by engagement of the two detachable connecting structures.

4. The dual wireless earphones according to claim 3, wherein the detachable connecting structures are a magnetic attraction structure or a clamping structure.

5. The dual wireless earphones according to claim 3, wherein opposite side walls of the earphone body are both provided with the detachable connecting structure.

6. The dual wireless earphones according to claim 3, wherein opposite side walls of the earphone body are both provided with the detachable connecting structure and the copper post.

7. The dual wireless earphones according to claim 1, wherein a detachable connecting structure corresponding to the detachable connecting structure of the connector is provided on the earphone body; and a detachable connecting between the earphone body and the connector is achieved by engagement of the two detachable connecting structures.

8. The dual wireless earphones according to claim 7, wherein the detachable connecting structures are a magnetic attraction structure or a clamping structure.

9. The dual wireless earphones according to claim 7, wherein opposite side walls of the earphone body are both provided with the detachable connecting structure.

10. The dual wireless earphones according to claim 7, wherein opposite side walls of the earphone body are both provided with the detachable connecting structure and the copper post.

* * * * *